United States Patent [19]

Nightingale

[11] 4,166,459

[45] Sep. 4, 1979

[54] CERVICAL TRACTION UNIT

[75] Inventor: Frank J. Nightingale, San Diego, Calif.

[73] Assignee: Union Camp Corporation, Wayne, N.J.

[21] Appl. No.: 810,967

[22] Filed: Jun. 29, 1977

[51] Int. Cl.[2] ..... A61H 1/02

[52] U.S. Cl. ..... 128/75; 269/328; 5/440

[58] Field of Search ..... 128/70, 71, 75, 76 R, 128/69, 83, 84 R, 84 C, 72, 73, 74; 5/327 B, 327 R, 335, 334 R; 269/328

[56] References Cited

U.S. PATENT DOCUMENTS

| | | | |
|---|---|---|---|
| 3,113,326 | 12/1963 | Hyde et al. | 5/335 |
| 3,124,126 | 3/1964 | Spinks | 128/71 |
| 3,221,735 | 12/1965 | Goodman | 128/75 |
| 3,404,679 | 10/1968 | Bevilacqua | 128/71 |
| 3,554,189 | 1/1971 | Hendrickson | 128/71 |
| 3,599,632 | 8/1971 | Childers | 128/75 |
| 3,621,839 | 11/1971 | Barthe | 128/84 R |
| 3,720,965 | 3/1973 | Wright | 5/327 B |
| 3,732,863 | 5/1973 | Harrington | 128/75 |
| 3,817,509 | 6/1974 | Komline | 269/328 |
| 3,828,377 | 8/1974 | Fary, Sr. | 128/76 R |
| 4,033,339 | 7/1977 | Roberts | 128/73 |

OTHER PUBLICATIONS

Dupuy Catalog, *Surgical Prop Cushion,* p. 20, Dupuy Inc., Warsaw, Ind. Copyright 1954.

*Primary Examiner*—Robert W. Michell
*Assistant Examiner*—Arthur S. Rose
*Attorney, Agent, or Firm*—Brown & Martin

[57] ABSTRACT

A cervical traction unit which fits over and is retained on one end of a mattress or similar support. The unit has a platform which rests on the mattress and carries a sliding carriage with a raised neck supporting yoke to receive the neck of a patient lying on the mattress. The carriage is elastically biased to apply a controlled and indicated traction force to the patient's neck, without the need for straps or harnesses.

2 Claims, 3 Drawing Figures

CERVICAL TRACTION UNIT

BACKGROUND OF THE INVENTION

Apparatus for applying cervical traction to an individual usually involves the use of straps, harnesses, collars, head bands and the like, in addition to body restraints. Most of the equipment in use is uncomfortable for the wearer and requires some time, and often assistance, to set up. Some apparatus requires a special frame, or at least attachment fittings, for securing the elements to a bed or other support. Such apparatus is often unnecessarily complex and expensive.

SUMMARY OF THE INVENTION

The cervical traction unit described herein is a very simple structure which fits on the end of a mattress, or other such support, and does not require any frame, straps, harness, or other restraints. The unit has a platform which rests on the mattress, one end of the platform having a downwardly turned rear wall which bears against the end of the mattress, and has a flap to extend under the mattress and hold the unit in place. On the platform is a sliding carriage on which is a raised neck supporting yoke. Elastic tension members bias the carriage toward the rear of the platform.

A patient reclines on the mattress with the neck held in the yoke and is held in place by body weight, no restraints being required. The yoke is shaped to support the neck raised and tilted back only slightly from a normal supine position, which is not particularly uncomfortable. The yoke engages the head at the base of the skull to apply the traction force, which is on the order of 10 to 13 pounds maximum and is indicated on a scale along one side of the platform. It has been found that the weight of the head is sufficient to keep the neck properly engaged, without need for straps or the like.

The unit can be set up in a few seconds without the need for particular skill or assistance and the patient is completely unrestrained.

The primary object of this invention, therefore, is to provide a new and improved cervical traction unit.

Another object of this invention is to provide a cervical traction unit which is held in place on a mattress or the like without special attachments.

Another object of this invention is to provide a cervical traction unit which will apply a controlled traction force, with the user lying unrestrained in a normal supine position.

A further object of this invention is to provide a cervical traction unit which is economical to manufacture and simple to use.

Other objects and advantages will be apparent in the following detailed description, taken in conjunction with the accompanying drawing, in which.

DESCRIPTION OF THE PREFERRED EMBODIMENT

Figure 1:
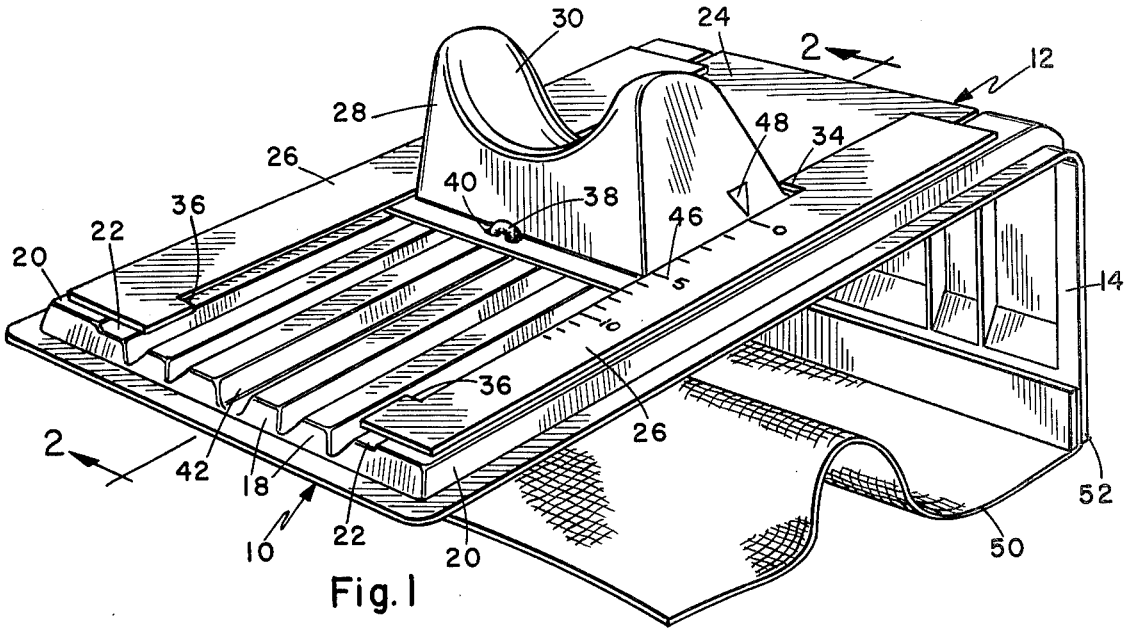
FIG. 1 is a perspective view of the complete cervical traction unit.

The cervical traction unit comprises two basic components, a platform 10 and a carriage 12, both of which can be molded or otherwise formed from plastic or other suitable material.

Platform 10 is of generally rectangular configuration and has a downwardly turned rear wall 14, which engages the end of a mattress 16, or the like, on which the platform is resting. The platform is reinforced by longitudinal raised ribs 18, which extend into the rear wall 14 to provide a rigid structure. The specific number and configuration of the ribs is not critical. Along the sides of platform 10 are raised side rails 20 with inner recessed tracks 22.

Carriage 12 comprises a generally flat plate member 24 which rests on tracks 22 and slides longitudinally between the side rails 20. The carriage is held in place by retaining flanges 26, secured on top of side rails 20 by adhesive or other suitble means, and projecting inwardly over tracks 22.

Figure 2:
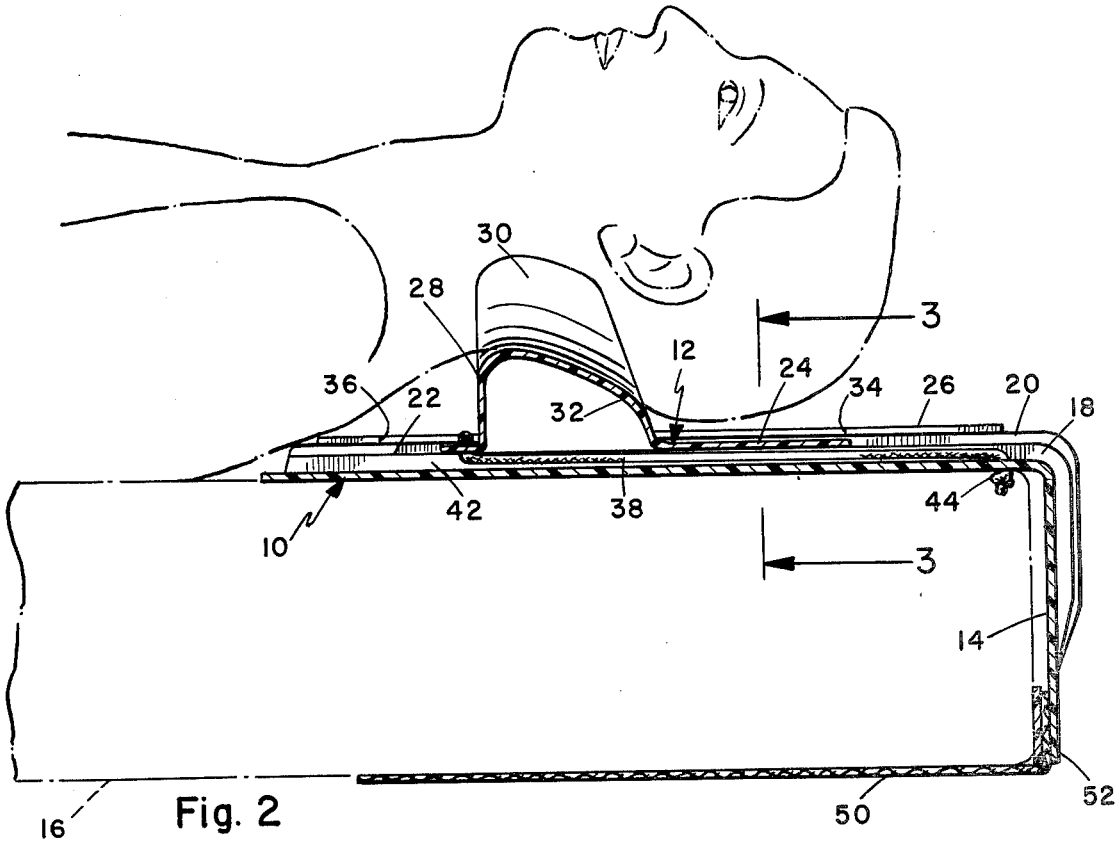
FIG. 2 is a sectional view taken on line 2—2 of FIG. 1 and showing the unit in use.
Figure 3:
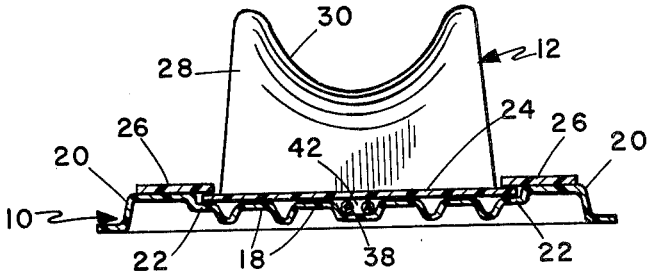
FIG. 3 is a sectional view taken on line 3—3 of FIG. 2.

Extending upwardly from the forward end portion of plate member 24 is a neck support 28 with a recessed yoke 30 shaped to receive the neck of a user. The lower wall portion 32 of yoke 30 curves downwardly toward the rear, as in FIG. 2, to hold the user's neck with the head tilted slightly back, so that the yoke engages the head generally under the base of the skull. Retaining flanges 26 have inwardly projecting rear stops 34 and front stops 36, to engage neck support 28 and limit the travel of the carriage.

The carriage is biased to the rear by a traction member, illustrated as an elastic cord 38. The elastic cord is looped through holes 40 in the forward end of plate member 24 and extends along a channel 42 between ribs 18. The rear ends of elastic cord 38 pass through the rear portion of platform 10 and are retained by knots 44. A spring may be used if desired, but the elastic cord is simple to install, low in cost and requires minimum clearance between the platform and carriage. A scale 46 is marked on one retaining flange 26, and the neck support 28 has an indicator 48 to show the force being applied by the tension of the elastic cord. The force involved is on the order of 13 pounds maximum, which is within safe limits for use without constant supervision.

The unit is held in place on mattress 16 by a retaining flap 50 of fabric or flexible plastic material. The flap is secured to the lower edge 52 of rear wall 14 by adhesive or other suitable means, and extends forwardly under the mattress, so that the weight of the mattress holds the unit securely. The use of a flexible flap also allows the unit to fit on mattresses or other supports of different thicknesses.

In use the individual is supine on the mattress and the carriage 12 is pulled forward to required load position on scale 46. The individual's neck is placed in yoke 30 and the carriage is released, allowing the elastic cord to apply the traction force. Adjustments to obtain the correct loading may be made by movement of the individual, who is not restrained in any manner. Since the load involved is quite low, body weight is sufficient to hold the individual in place. It has been found that the weight of the head in the shaped yoke is adequate to hold the neck in place without restraint. The traction unit is thus very easy to set up and apply and the user is free to disengage at any time without assistance.

Having described my invention, I now claim:

1. A cervical traction unit, comprising:

an elongated platform having a substantially rigid rear end wall extending downwardly from said platform, said wall being adapted to engage one end of a support on which the platform is placed, a flexible flap being of such degree of flexibility that it may at any point be bent to an angle of at least 90° with substantially no permanent deformation occurring in the material of the flap, said flap being secured to said wall for insertion under a support to secure the platform thereon, said rear wall and said flap acting together to hold the platform against longitudinal displacement when the unit is mounted on a support;

a carriage longitudinally slidably mounted on said platform and having a raised neck supporting member thereon, the neck supporting member having a recessed neck receiving yoke to receive the neck of a user supine on the support, with a downwardly inclined rear wall portion to engage the user's head substantially under the base of the skull for applying traction to the otherwise unrestrained head of the user;

and tension means connected between said carriage and the rear end portion of said platform to bias the carriage rearwardly.

2. A cervical traction unit according to claim 1, wherein said platform has longitudinally extending raised ribs on which said carriage rides, said ribs defining at least one channel therebetween;

said tension means comprising an elastic cord extending below said carriage in said channel.

* * * * *